US009492025B1

(12) United States Patent
Wu

(10) Patent No.: US 9,492,025 B1
(45) Date of Patent: Nov. 15, 2016

(54) CLOTHES HANGING DEVICE

(71) Applicant: Ming-Kun Wu, Taichung (TW)

(72) Inventor: Ming-Kun Wu, Taichung (TW)

( * ) Notice: Subject to any disclaimer, the term of this patent is extended or adjusted under 35 U.S.C. 154(b) by 0 days.

(21) Appl. No.: 14/857,833

(22) Filed: Sep. 18, 2015

(51) Int. Cl.
*A47G 25/14* (2006.01)
*A47G 25/40* (2006.01)
*A47G 25/18* (2006.01)
*A47G 25/28* (2006.01)

(52) U.S. Cl.
CPC ..... *A47G 25/1414* (2013.01); *A47G 25/18* (2013.01); *A47G 25/28* (2013.01); *A47G 25/40* (2013.01)

(58) Field of Classification Search
CPC .. A47G 25/18; A47G 25/14; A47G 25/1414; A47G 25/40; A47G 25/28; A47G 25/32; A47G 25/48; A47G 25/488; A47G 25/50; A47G 25/62; A47G 25/621; B65D 85/18; A41D 27/22; A47B 61/003
USPC ..... D6/319, 323, 328
See application file for complete search history.

(56) References Cited

U.S. PATENT DOCUMENTS 2,271,941 A * 2/1942 Kemmitt ..... A47B 61/003 211/113
2,298,491 A * 10/1942 Lamar ..... A47G 25/70 223/88
2,395,210 A * 2/1946 Baril ..... D06F 57/12 211/89.01
2,449,868 A * 9/1948 Waldman ..... A47G 25/18 223/88
3,207,392 A * 9/1965 Ericson ..... A47G 25/28 223/85
3,225,977 A * 12/1965 Gandy ..... A47G 25/18 211/113
3,448,903 A * 6/1969 Snow ..... A47G 25/48 223/96
4,168,791 A * 9/1979 Clark, Jr. ..... A47G 25/50 223/94
2016/0045050 A1* 2/2016 Hall ..... A47G 25/28 223/85

* cited by examiner

*Primary Examiner* — Ismael Izaguirre
(74) *Attorney, Agent, or Firm* — Guice Patents PLLC

(57) ABSTRACT

A clothes hanging device comprises a frame, a pivoting member, and a hanging hook. The frame has a plurality of racks connected around with one another. A connection rod is arranged between every two relative racks. The pivoting member is arranged on the connection rod. A ball groove and a cutting groove are arranged at the pivoting member and the cutting groove is communicated with the ball groove. The hanging hook has an assembling portion, a hook portion, and a shaft portion. The assembling portion is pivoted in the ball groove. The shaft portion is deflected partially and hooked in the cutting groove due to the assembling portion being pivoted at the ball groove. Therefore, it may be quickly ventilated, easy to circulate the air, and shorten the natural air-dried time of the hanging clothes.

6 Claims, 12 Drawing Sheets

CLOTHES HANGING DEVICE

BACKGROUND OF THE INVENTION

1. Field of the Invention

The present invention relates to a clothes hanging device, and especially relates to a clothes hanger capable for applying to hang clothes conveniently and for various uses.

2. Description of Related Art

The conventional clothes hangers are one piece by bending a metal wire. It may have a hook portion and a supporting portion with a triangular shape. When in use, the supporting portion is covered by the clothes or the clothes are hanged on the supporting portion so that the clothes can be located on the hanger. The hanger is hooked outside by the hook portion to make the clothes dry. Since the hanger is flat, the front and rear sides of the clothes are easy to contacted with each other due to the wet clothes. The clothes cannot be expanded to make the air circulate thereinside so that the time for drying the clothes is longer and the ceases are easy to be generated corresponding to the shoulders due to the weight of water which is stayed at the wet clothes. Therefore, the clothes need to be ironed after drying. In order to improve above mentioned issue, a new clothes hanger which is capable for expanding the clothes is developed. Although the new clothes hanger can improve the issue of air circulation, it cannot be folded to be storage and occupies the space.

The clothes hanger is the most popular in drying clothes. The clothes may be formed by bending an iron wire or plastic injection molding. The disadvantage of the clothes hanger which is formed by bending the iron wire is that the plastic layer for covering the iron wire is easy to be damaged and the clothes are easy to be contaminated by the rust of the iron wire. Although the clothes hanger which is formed by plastic injection molding does not have the disadvantage of the one which is formed by bending the iron wire, the specific size of the clothes hanger after plastic injection molding cannot to assemble to extend. Each clothes hanger has only two clasps which are not enough to be used. A user need to prepare more clothes hangers for hanging more clothes. It makes the cost increase and the multiple clothes hangers be placed in disorder. The clasps of each clothes hanger is easy to impede other clothes hangers to make hard to take. The strength of the clothes hangers which are formed by plastic injection molding is finite and easy to be damaged and broken.

In view of the foregoing circumstances, the inventor has invested a lot of time to study the relevant knowledge, compare the pros and cons, research and develop related products. After quite many experiments and tests, the "clothes hanging device" of this invention is eventually launched to improve the foregoing shortcomings, to meet the public use.

SUMMARY OF THE INVENTION

An object of this invention is providing a clothes hanging device. When hanging clothes, two sides of the clothes hanging device are not inclined due to being asymmetric and the weight of the clothes is evenly acted on the racks which are hanging clothes. Therefore, besides it may improve the creases at the hanged clothes which are hanged on a conventional clothes hanging device and the creases are corresponding to the shoulders, it may make the hanged clothes which is hanged on the clothes hanging device of the present invention form a solid space thereinside. It may be quickly ventilated, easy to circulate the air, and shorten the natural air-dried time of the hanging clothes. It may also hang single one or multiple clothes.

Another object of the present invention is that there are many types to be transformed and provide multiple selections for a user while hanging. For storage, the type of the present invention is transformed for convenient storage and saving space.

One another object of the present invention is that the clothes hanging device may be transformed to various types through the hook portion, the shaft portion, and the connection portion pivoting with each other while in the horizontal status. It may be used for placing books or tablet PC for convenient and various uses.

In order to achieve above mentioned objects and effects, a clothes hanging device is provided. The clothes hanging device may comprise a frame, having a plurality of racks connected around with one another, a connection rod is arranged between every two relative racks, and a plurality of locking rings is arranged at each of the racks and the connection rod; a pivoting member, arranged on the connection rod, a ball groove and a cutting groove are arranged at the pivoting member and the cutting groove is communicated with the ball groove; and a hanging hook, having an assembling portion, a hook portion, and a shaft portion, two ends of the shaft portion are respectively connected with the assembling portion and the hook portion, the assembling portion is pivoted in the ball groove, the shaft portion is deflected partially and hooked in the cutting groove due to the assembling portion being pivoted at the ball groove, the hanging hook is deflected relative to the pivoting member, and the frame is changed to be in a horizontal status or a vertical status relative to the hanging hook.

In some embodiments, two pivoting ears are arranged at one end of the hook portion, a convex block is arranged at one end of the shaft portion, and a pivoting shaft is passing through the pivoting ears and the convex block, the hook portion is deflected relative to the shaft portion.

In some embodiments, a connection portion is further arranged at the hanging hook, two ends of the connection portion are respectively pivoted at the hook portion and the shaft portion, and the connection portion is deflected relative to the shaft portion and the hook portion.

In some embodiments, the hanging hook is hanged at a locking ring of another clothes hanging device.

The various objectives and advantages of the present invention will be more readily understood from the following detailed description when read in conjunction with the appended drawing.

DETAILED DESCRIPTION OF THE INVENTION

Figure 1:
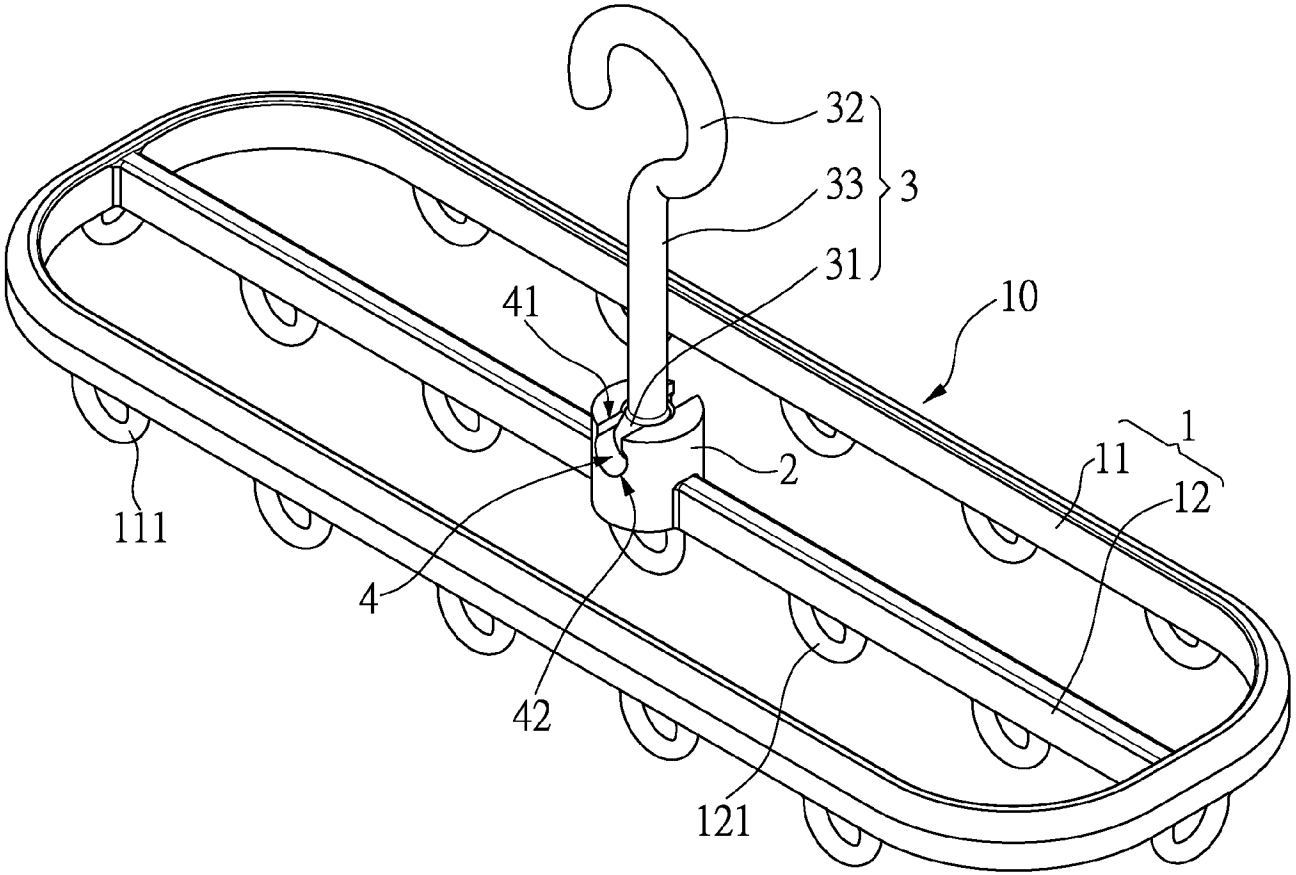
FIG. 1 is a perspective view of a first embodiment of a clothes hanging device of the present invention.

To describe clearly that the present invention achieves the foregoing objective and function, the technical features and desired function are described with reference to a preferred embodiment and accompanying drawings.

Please reference to FIGS. 1 to 7, a clothes hanging device of the present invention may comprise a frame 1, a pivoting member 2, and a hanging hook 3. The frame 1 may have a plurality of racks 11 connected around with one another. A connection rod 12 is arranged between every two relative racks 11. A plurality of locking rings 111, 121 is arranged at each of the racks 11 and the connection rod 12. The pivoting member 2 may be arranged on the connection rod 12. A ball groove 21 and a cutting groove 4 are arranged at the pivoting member 2 and the cutting groove 4 is communicated with the ball groove 21. The hanging hook 3 may have an assembling portion 31, a hook portion, 32 and a shaft portion 33. Two ends of the shaft portion 33 are respectively connected with the assembling portion 31 and the hook portion 32. The assembling portion 31 is pivoted in the ball groove 21. The shaft portion 33 is deflected partially and hooked in the cutting groove 4 due to the assembling portion 31 being pivoted at the ball groove 21. The hanging hook 3 is deflected relative to the pivoting member 2 and the frame 1 is changed to be in a horizontal status or a vertical status relative to the hanging hook 3.

According to above mentioned structure and please refer to FIG. 1, the frame 1 is rectangular and each corner of the frame 1 is arc. The frame 1 has a plurality of racks 11 connected around with one another. The connection rod 12 is arranged at a center between the racks 11. A plurality of locking rings 111, 121 is arranged at each of the racks 11 and the connection rod 12. The pivoting member 2 is arranged on the connection rod 12. The pivoting member 2 is arranged at a center of the connection rod 12. The ball groove 21 and the cutting groove 4 are arranged at the pivoting member 2 and the cutting groove 4 is communicated with the ball groove 21. The ball groove 21 is arranged at a center of the cutting groove 4. The cutting groove 4 has a small diameter portion 41 and a large diameter portion 42. The hanging hook 3 has the assembling portion 31, the hook portion, 32 and the shaft portion 33. Two ends of the shaft portion 33 are respectively connected with the assembling portion 31 and the hook portion 32. The assembling portion 31 is a ball shape which is corresponding to the ball groove 21. The hook portion 32 of the hanging hook 3 is provided for hanging on a clothes hanging rod. The assembling portion 31 is pivotably arranged in the ball groove 21. Please refer to FIGS. 1 to 3, the shaft portion 33 is deflected partially and hooked in the cutting groove 4 due to the assembling portion 31 being pivoted at the ball groove 21. When the hanging hook 3 is deflected toward the cutting groove 4, the shaft portion 33 is pivoted in the ball groove through the assembling portion 31 and capable for deflecting and moving into the cutting groove 4. Furthermore, the shaft portion 33 is passing through the small diameter portion first and then hooked in the large diameter portion 42 so that the hanging hook 3 which is in the horizontal status relative to the frame 1 is deflected to be in the vertical status. The status changing is convenient for a user to hang more clothes.

In addition, when the hanging hook 3 is pivoted relative to the pivoting member 2, the frame 1 may change to be in the horizontal status and the vertical status relative to the hanging hook 3. The frame 1 is deflected from the horizontal status which is capable for hanging single clothes to the vertical status which is capable for hanging more than one clothes. Because the connection rod 12 is arranged at the center of the racks 11, the structure of the frame 1 is much firmer. When hanging clothes, two sides of the clothes hanging device are not inclined due to being asymmetric and the weight of the clothes is evenly acted on the racks 11 which are hanging clothes. Therefore, besides it may improve the creases at the hanged clothes which are hanged on a conventional clothes hanging device and the creases are corresponding to the shoulders, it may make the hanged clothes which is hanged on the clothes hanging device of the present invention form a solid space thereinside. It may be quickly ventilated, easy to circulate the air, and shorten the natural air-dried time of the hanging clothes (shown as in FIG. 4). It may also hang single one or multiple clothes.

Figure 2:
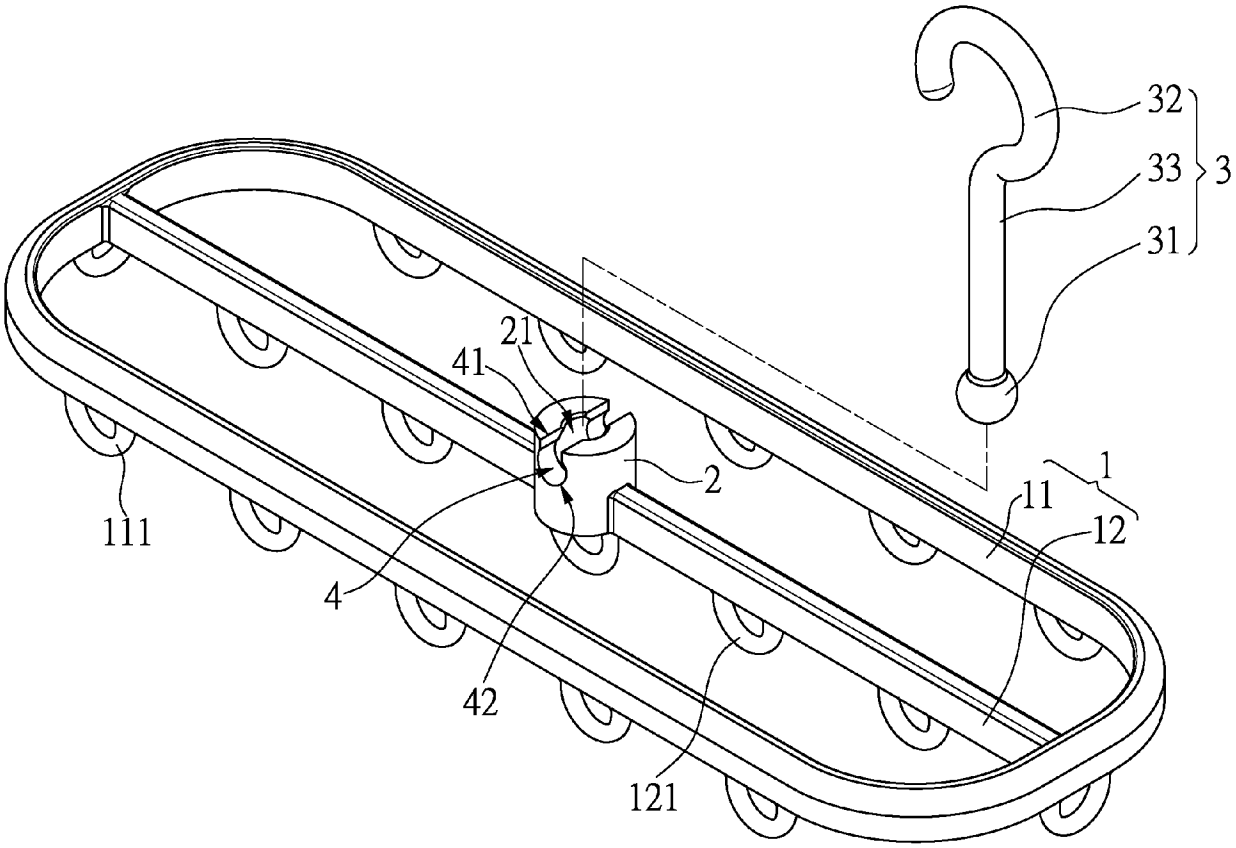
FIG. 2 is an exploded view of the clothes hanging device of the present invention.
Figure 3:
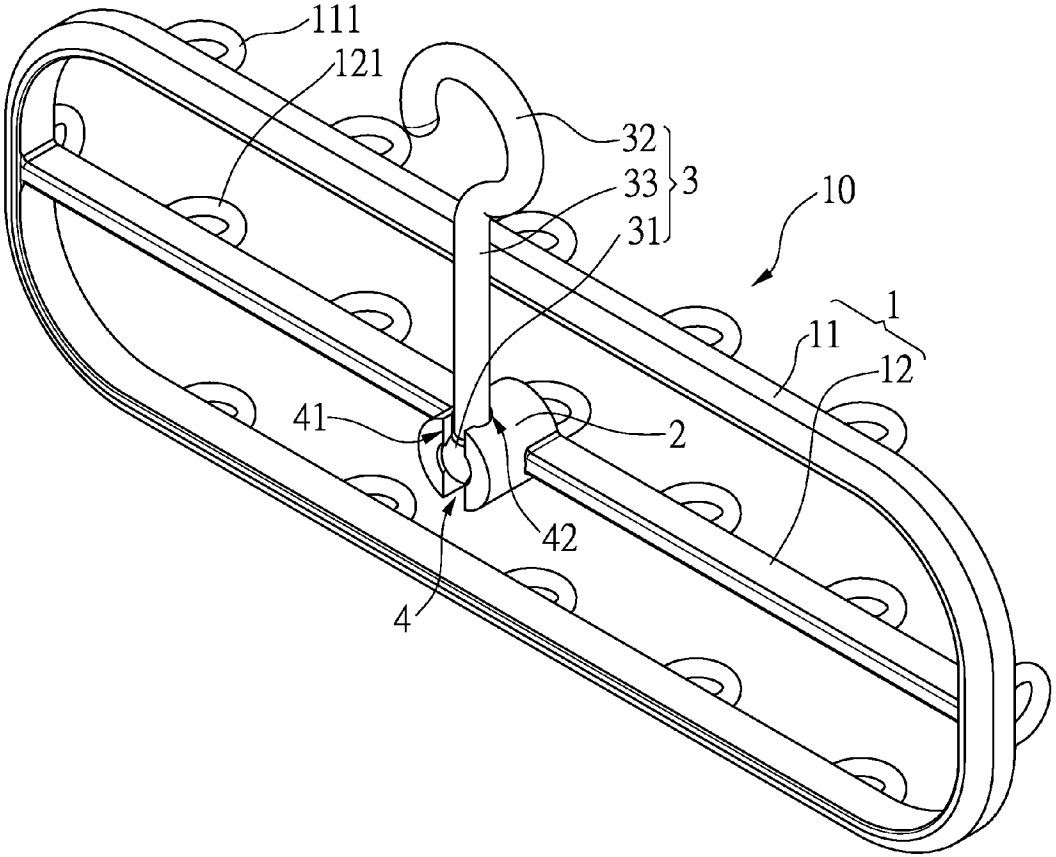
FIG. 3 is a view of the clothes hanging device of the present invention while the frame is in the vertical status.
Figure 4:
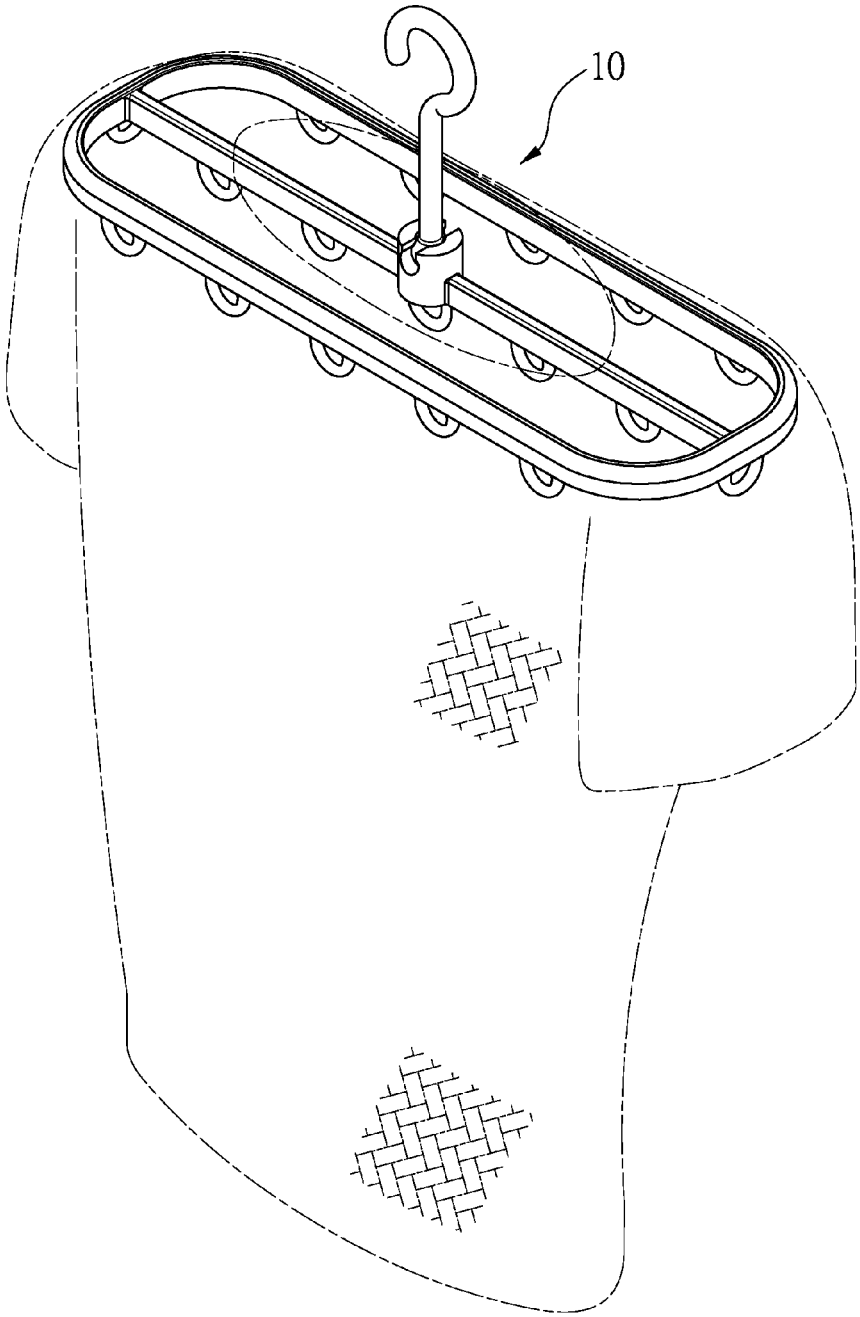
FIG. 4 is a view of the clothes hanging device of the present invention while in operation.
Figure 5:
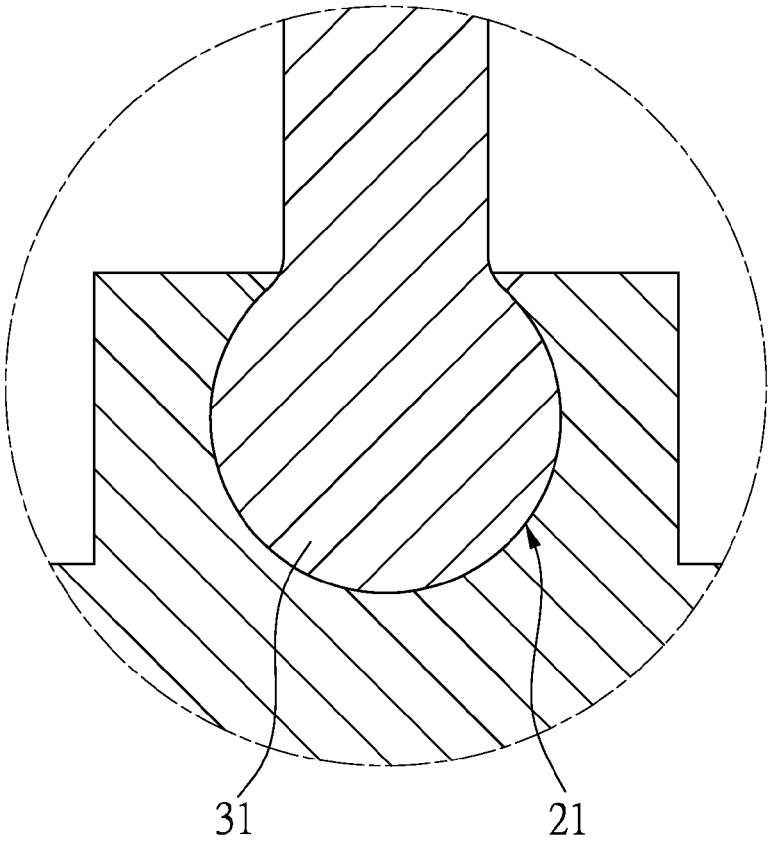
FIG. 5 is a cross-sectional view of the clothes hanging device of the present invention while the assembling portion is pivoted in the ball groove.

Furthermore, please refer to FIGS. 1 to 3, when the clothes is hanged on the clothes hanging device of the present invention, the hanged clothes may be expanded by the locking rings 111 which are arranged around each rack 11 and form the solid space thereinside so that the air is quickly ventilated and easy to be circulated to shorten the natural air-dried time of the hanged clothes. In addition, a plurality of clasps (not shown) may be further assembled at the locking rings 111 and 121 and provide for clipping smaller objects, such as stocks, towels, handkerchiefs, underwear, and so on. Each clasp may be assembled to the corresponding licking ring 111 or 121 with a hook, but not limited thereto. Besides, the locking rings 111 and 121 may be also provided for hanging the conventional clothes hanging device (not shown).

Figure 6:
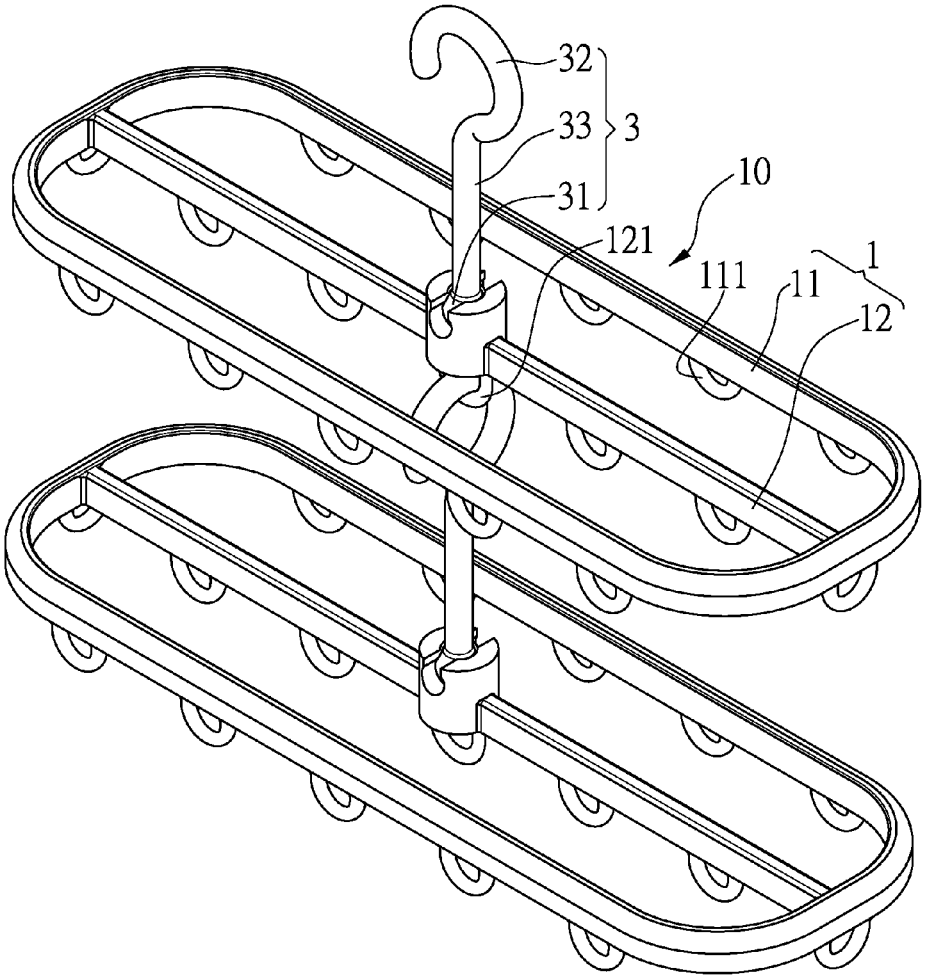
FIG. 6 is a view of the clothes hanging device of the present invention while in a horizontal status and hanging another clothes hanging device.
Figure 7:
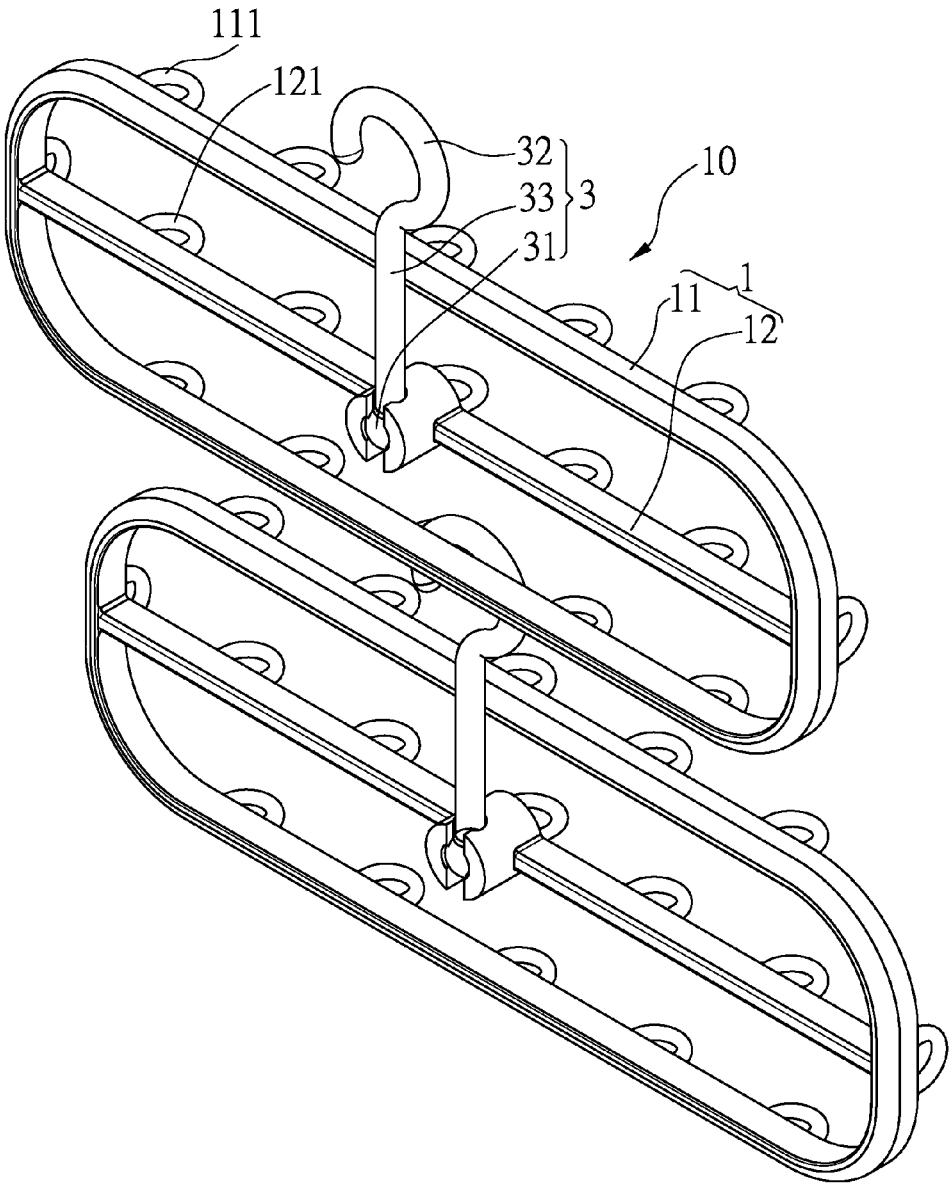
FIG. 7 is a view of the clothes hanging device of the present invention while in the vertical status and hanging another clothes hanging device.

Please refer to FIGS. 6 and 7, the hanging hook 3 is hanged at the locking ring 111 or 121 of another clothes hanging device of the present invention so that the two clothes hanging devices may be respectively in the horizontal status and the vertical status for a user to select and the hanging space of a stick for hanging the clothes hanging devices may be saved.

Figure 8:
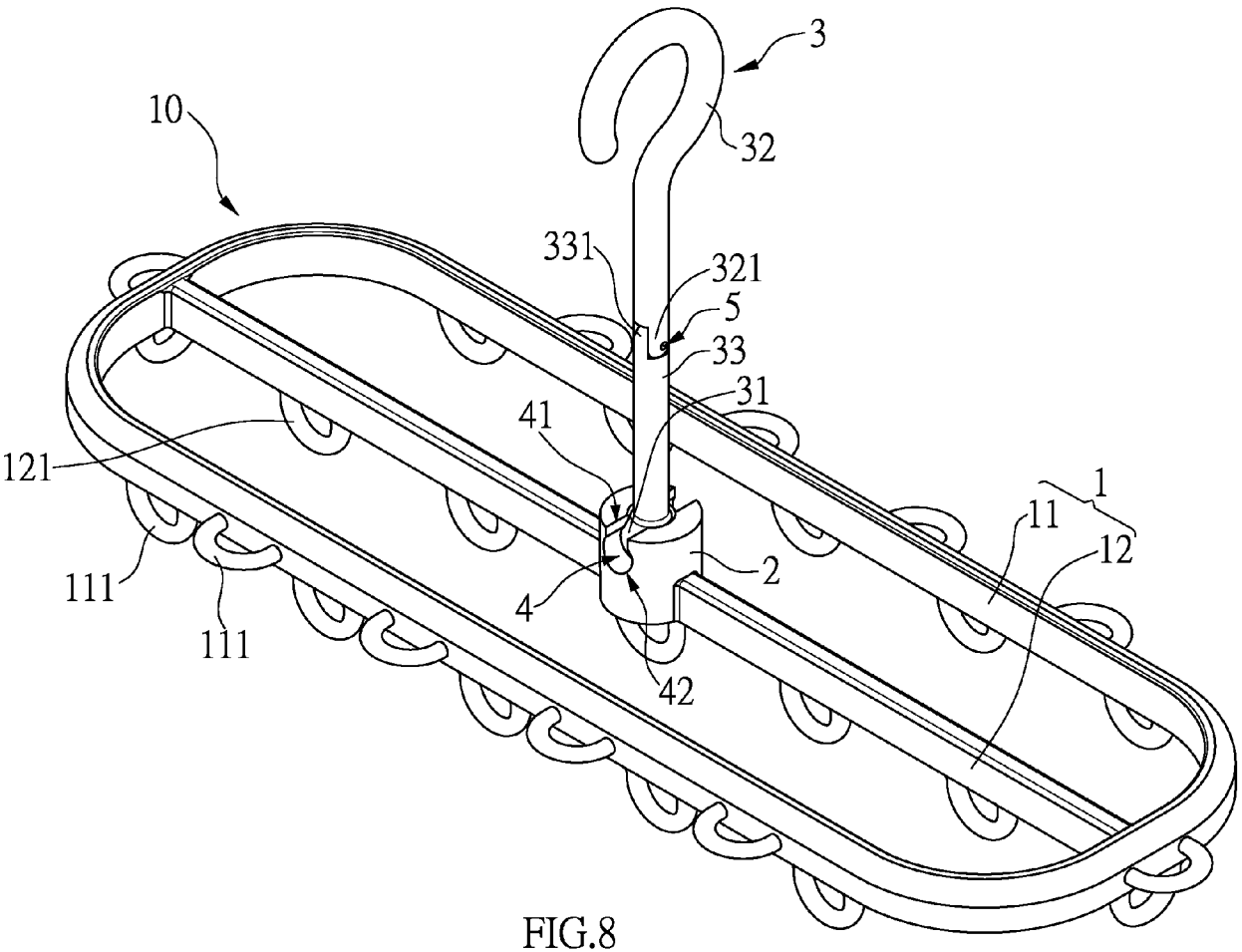
FIG. 8 is a perspective view of a second embodiment of the clothes hanging device of the present invention.
Figure 9:
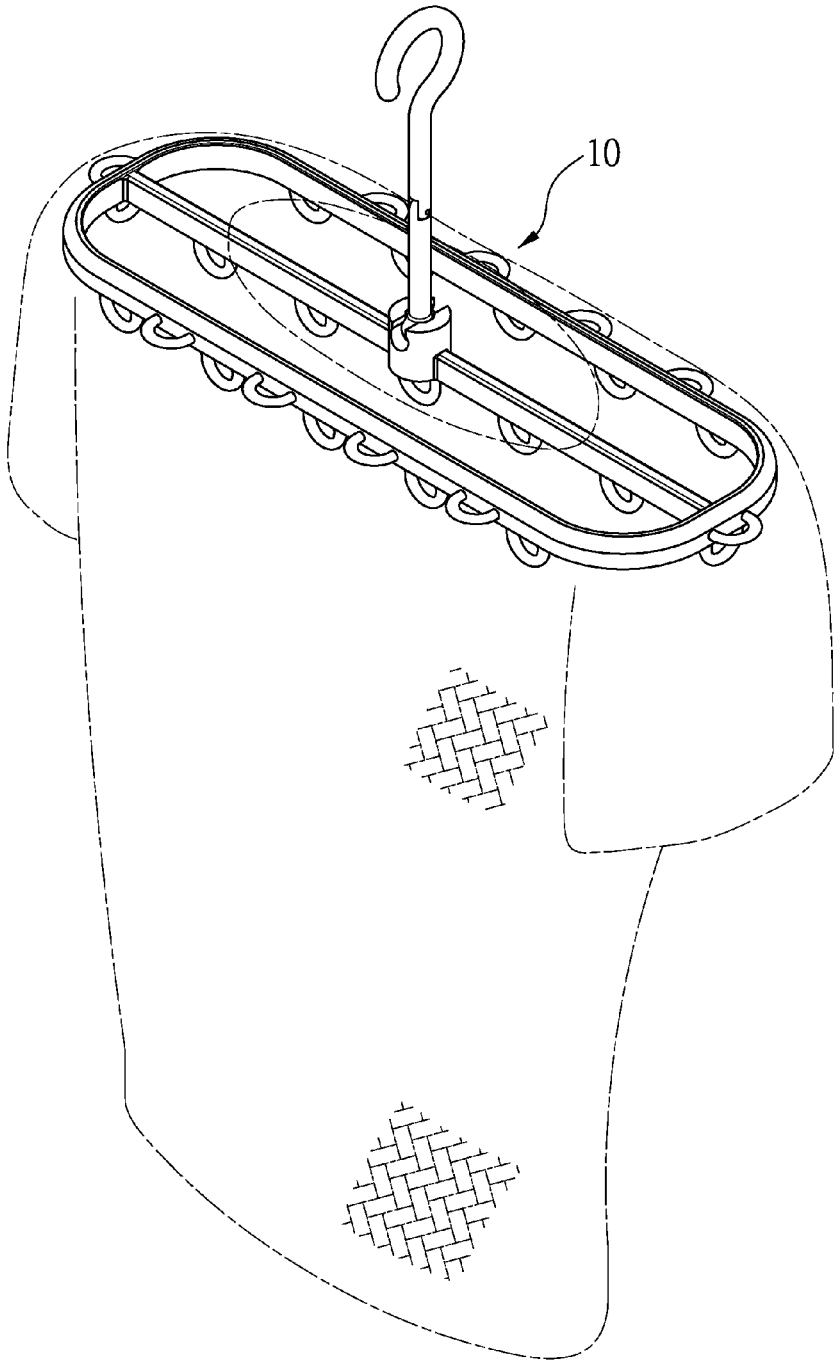
FIG. 9 is a view of the second embodiment of the clothes hanging device of the present invention while in operation.

Please refer to FIGS. 8 and 9, when the clothes is hanged on the clothes hanging device of the present invention, the clothes may be expanded by the locking rings 111 which are arranged around each rack 11 and the solid space may be formed thereinside so that it may be quickly ventilated, easy to circulate the air, and shorten the natural air-dried time of the hanging clothes.

Figure 10:
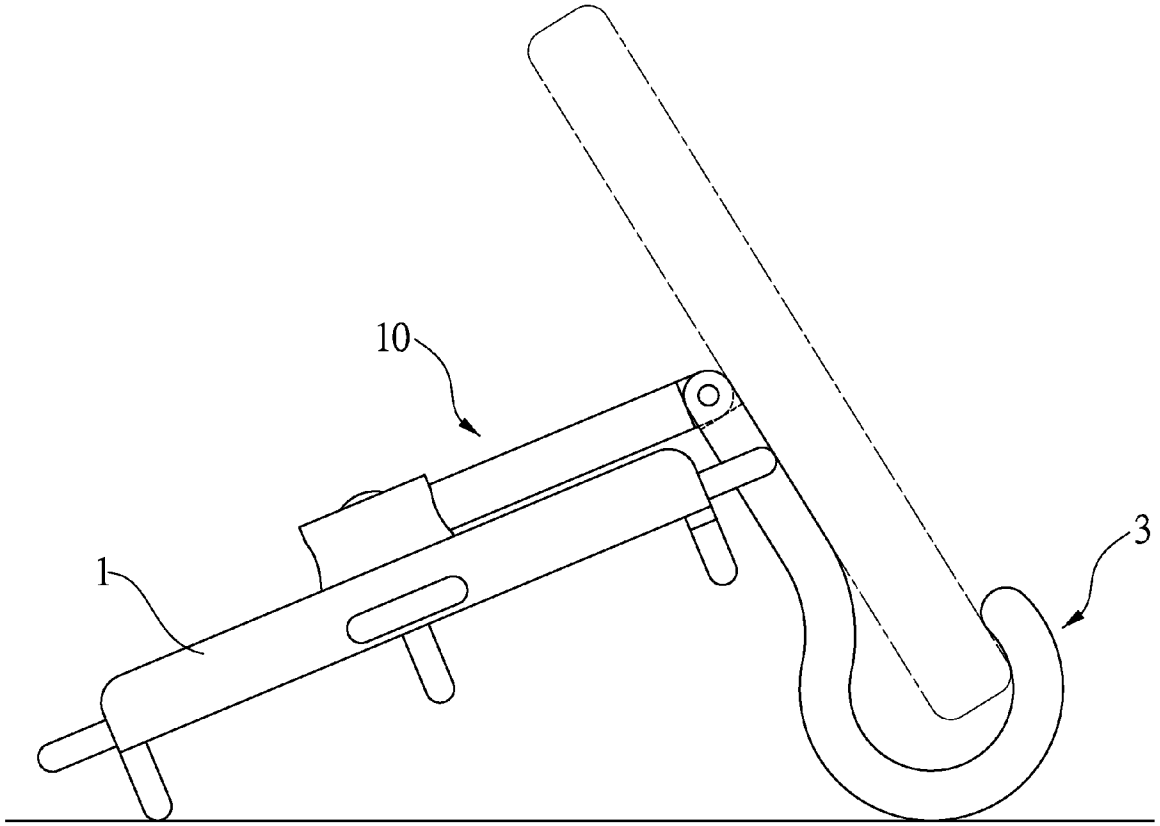
FIG. 10 is another view of the second embodiment of the clothes hanging device of the present invention while in operation.

Please refer to FIG. 8, two pivoting ears 321 may be arranged at one end of the hook portion 32. A convex block 331 may be arranged at one end of the shaft portion 33. And a pivoting shaft 5 may be passing through the pivoting ears 321 and the convex block 331 so that the hook portion 32 may be deflected relative to the shaft portion 33. When the assembling portion 31 is deflected relative to the pivoting member 2 to be in the vertical status, the hook portion 32 of the hanging hook 3 is deflected from a side of the frame 1 which is adjacent to the shaft portion 33 to the other side thereof through the hook portion 32 pivoting at the shaft portion 33. And then the clothes hanging device of the present invention is formed V-shaped. Therefore, the books or tablet PCs (shown as in FIG. 10) may be placed at the V-shaped clothes hanging device of the present for various uses.

Figure 11:
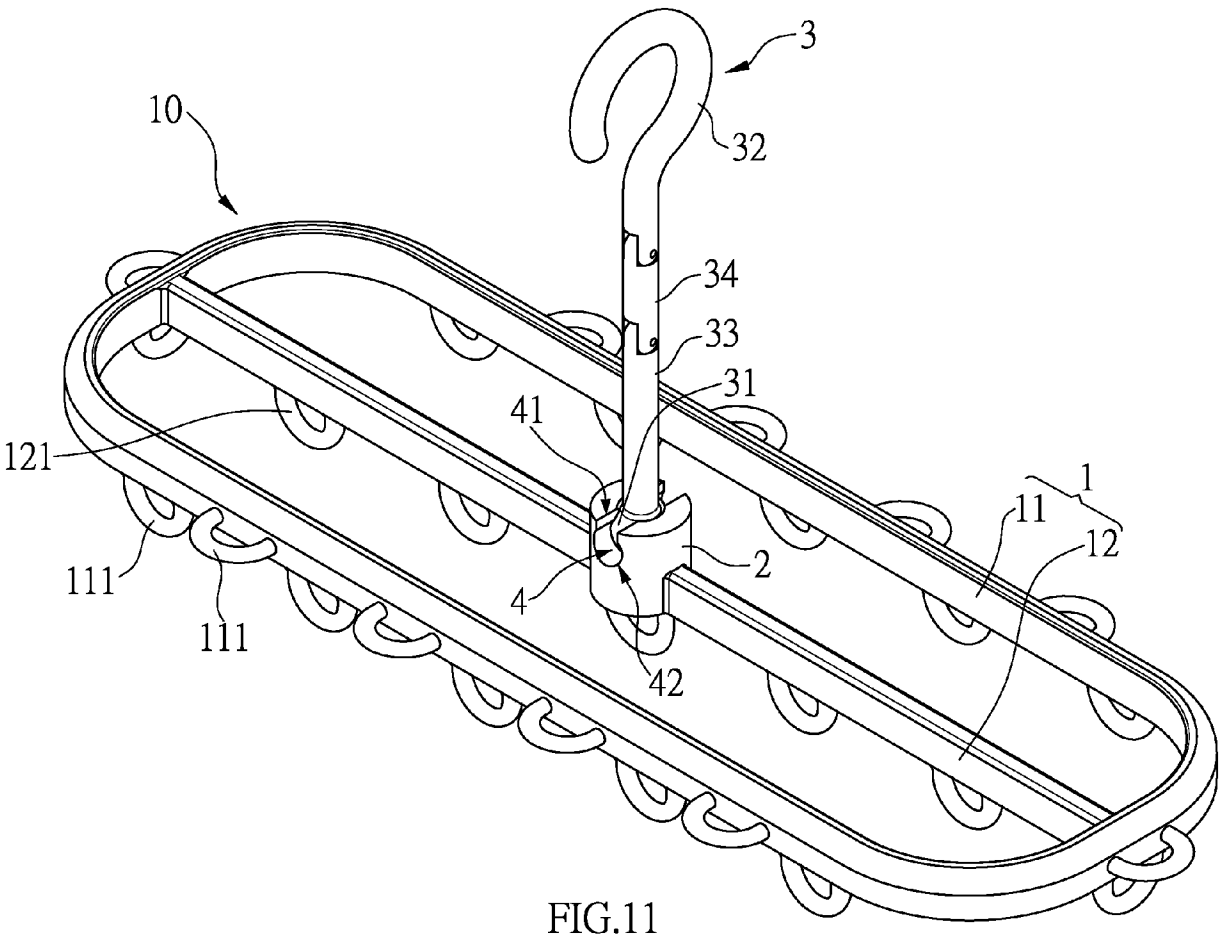
FIG. 11 is a perspective view of a third embodiment of the clothes hanging device of the present invention.
Figure 12:
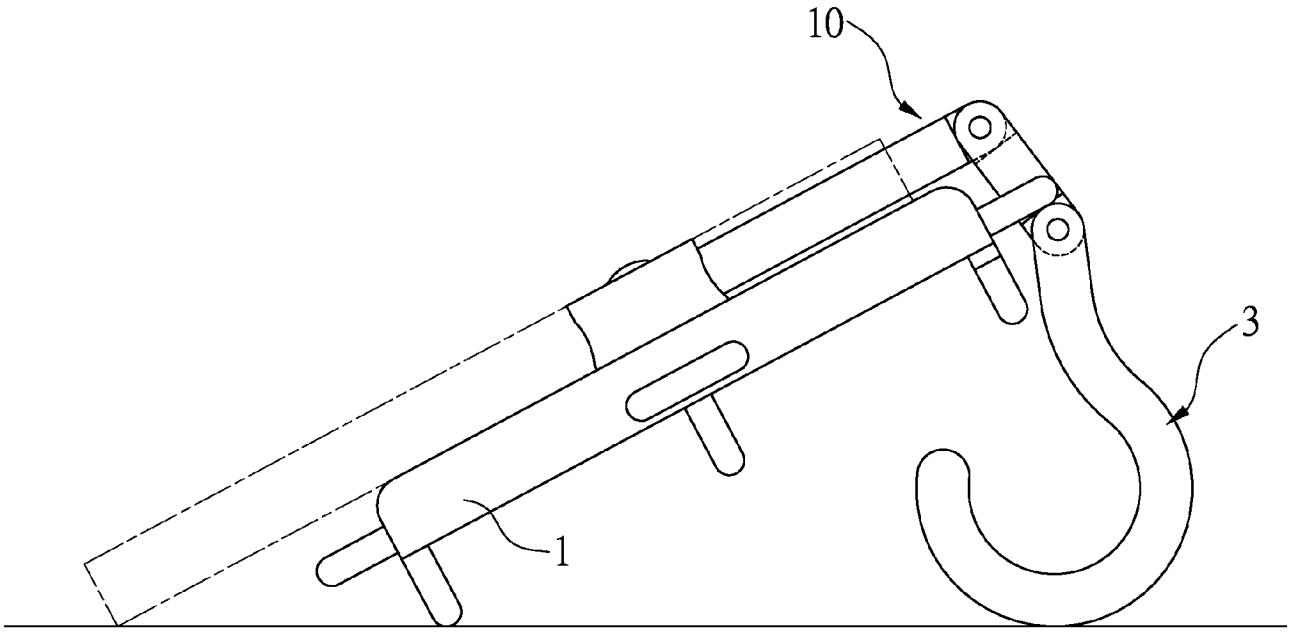
FIG. 12 is a view of the third embodiment of the clothes hanging device of the present invention while in operation.

Please refer to FIG. 11, a connection portion 34 may be further arranged at the hanging hook 3. Two ends of the connection portion 34 are respectively pivoted at the hook portion 32 and the shaft portion 33. The connection portion 34 may be deflected relative to the shaft portion 33 and the hook portion 32. When the assembling portion 31 is deflected relative to the pivoting member 2 to be in the vertical status, the hanging hook 3 may be deflected in three steps through the connection portion 34 of the hanging hook 3 pivoting at the hook portion 32 and the shaft portion 33. The hook portion 32 of the hanging hook 3 is deflected from the side of the frame 1 which is adjacent to the shaft portion 33 and the connection portion 34 to the other side thereof. Therefore, the books or tablet PC may be also placed at the clothes hanging device of the present invention (shown as in FIG. 12). It is convenient and with various uses.

In conclusion, the clothes hanging device 10 may have following effects.

The frame 1 is rectangular and each corner of the frame 1 is arc. When hanging clothes, two sides of the clothes hanging device are not inclined due to being asymmetric and the weight of the clothes is evenly acted on the racks 11 which are hanging clothes. Therefore, besides it may improve the creases at the hanged clothes which are hanged on a conventional clothes hanging device and the creases are corresponding to the shoulders, it may make the hanged clothes which is hanged on the clothes hanging device of the present invention form a solid space thereinside. It may be quickly ventilated, easy to circulate the air, and shorten the natural air-dried time of the hanging clothes.

Besides the clothes are hanged on the frame 1, the clasps may be further assembled at the locking rings 111 and 121 and provide for clipping smaller objects, such as stocks, towels, handkerchiefs, underwear, and so on.

the hanging hook 3 is hanged at the locking ring 111 or 121 of another clothes hanging device of the present invention so that the two clothes hanging devices may be respectively in the horizontal status and the vertical status for a user to select and the hanging space of a stick for hanging the clothes hanging devices may be saved. For storage, the shaft portion 33 of the hanging hook 3 is deflected toward the cutting groove 4 to be in the vertical status for storage and saving space.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A clothes hanging device, comprising:

a frame, having a plurality of racks connected around with one another, a connection rod is arranged between every two relative racks, and a plurality of locking rings is arranged at each of the racks and the connection rod;

a pivoting member, arranged on the connection rod, a ball groove and a cutting groove are arranged at the pivoting member and the cutting groove is communicated with the ball groove; and a hanging hook, having an assembling portion, a hook portion, and a shaft portion, two ends of the shaft portion are respectively connected with the assembling portion and the hook portion, the assembling portion is pivoted in the ball groove, the shaft portion is deflected partially and hooked in the cutting groove due to the assembling portion being pivoted at the ball groove, the hanging hook is deflected relative to the pivoting member, and the frame is changed to be in a horizontal status or a vertical status relative to the hanging hook.

2. The clothes hanging device as claimed in claim 1, wherein two pivoting ears are arranged at one end of the hook portion, a convex block is arranged at one end of the shaft portion, and a pivoting shaft is passing through the pivoting ears and the convex block, the hook portion is deflected relative to the shaft portion.

3. The clothes hanging device as claimed in claim 2, wherein the hanging hook is hanged at a locking ring of another clothes hanging device.

4. The clothes hanging device as claimed in claim 1, wherein a connection portion is further arranged at the hanging hook, two ends of the connection portion are respectively pivoted at the hook portion and the shaft portion, and the connection portion is deflected relative to the shaft portion and the hook portion.

5. The clothes hanging device as claimed in claim 4, wherein the hanging hook is hanged at a locking ring of another clothes hanging device.

6. The clothes hanging device as claimed in claim 1, wherein the hanging hook is hanged at a locking ring of another clothes hanging device.

* * * * *